United States Patent [19]

Tai et al.

[11] Patent Number: 4,615,815

[45] Date of Patent: Oct. 7, 1986

[54] FREE-FLOWING PARTICULATE FABRIC-SOFTENING ADJUNCT FOR USE IN LAUNDRY DETERGENT COMPOSITIONS AND METHOD OF MAKING SAME

[75] Inventors: Ho T. Tai; Léandre Naddeo, both of Lille, France

[73] Assignee: Lever Brothers Company, New York, N.Y.

[21] Appl. No.: 643,932

[22] Filed: Aug. 24, 1984

[30] Foreign Application Priority Data

Aug. 25, 1983 [GB] United Kingdom ..... 8322905

[51] Int. Cl.[4] ..... D06M 11/00

[52] U.S. Cl. ..... 252/8.8; 252/91; 252/99; 252/174.13; 252/186.31

[58] Field of Search ..... 252/8.6, 8.8, 528, 91, 252/99, 174.13, 135, 186.31

[56] References Cited

U.S. PATENT DOCUMENTS

| | | | |
|---|---|---|---|
| 3,769,222 | 10/1973 | Yurko et al. | 252/89 |
| 3,844,951 | 10/1974 | Fries et al. | 252/8.6 |
| 4,021,361 | 5/1977 | Lee | 252/102 |
| 4,055,505 | 10/1977 | Gray | 252/102 |
| 4,071,462 | 1/1978 | Matsunaga et al. | 252/99 |
| 4,075,116 | 2/1978 | Mesaros | 252/102 |
| 4,128,491 | 12/1978 | Melles | 252/95 |
| 4,292,035 | 9/1981 | Batrell | 8/137 |
| 4,422,950 | 12/1983 | Kemper et al. | 252/186.31 |

FOREIGN PATENT DOCUMENTS

| | | |
|---|---|---|
| 1048709 | 3/1979 | Canada . |
| 11340 | 5/1980 | European Pat. Off. . |
| 23367 | 2/1981 | European Pat. Off. . |
| 26528 | 4/1981 | European Pat. Off. . |

*Primary Examiner*—Paul Lieberman
*Assistant Examiner*—Willie J. Thompson
*Attorney, Agent, or Firm*—Milton L. Honig; James J. Farrell

[57] ABSTRACT

A free-flowing particulate fabric-softening adjunct for use in laundry detergent compositions is disclosed which comprises sodium perborate monohydrate having absorbed therein from about 5 to about 100% of its weight of a fabric-softening agent selected from the group consisting of organic compounds which contain primary, secondary, tertiary or quaternary nitrogen, or which are phosphonium or sulphonium compounds, having at least one, preferably two, relatively long hydrocarbon group substituents, conferring hydrophobicity and lubricity, and mixtures thereof.

A process for preparing such free-flowing particulate adjunct as well as fabric-softening detergent compositions which clean well and at the same time provide fabric-softening through the wash are also disclosed.

14 Claims, No Drawings

FREE-FLOWING PARTICULATE FABRIC-SOFTENING ADJUNCT FOR USE IN LAUNDRY DETERGENT COMPOSITIONS AND METHOD OF MAKING SAME

This invention relates to improved fabric- or textile-softening detergent compositions in particulate form and a process of preparing said improved compositions.

Fabric-softening detergent compositions, i.e. detergent compositions which clean and at the same time provide fabric softening through the wash, are known in the art and have been described in a number of patent publications.

In general, fabric-softening agents usable for incorporation in detergent compositions are organic compounds which contain primary, secondary, tertiary or quaternary nitrogen, or which are phosphonium or sulphonium compounds, and have at least one, preferably two, relatively long hydrocarbon group substituents conferring hydrophobicity and lubricity. Such fabric-softening agents are disclosed in U.S. Pat. No. 4,292,035.

French Patent Specification No. 2 236 925 discloses cationic quaternary ammonium compounds, particularly dimethyl distearyl ammonium chloride, as the fabric-softening agent in detergent compositions.

European Patent Applications No. 0011340, No. 0023367 and No. 0026528 disclose water-insoluble tertiary amines as the fabric-softening agent for use in detergent compositions.

Other types of materials, such as clays and cellulolytic enzymes, having fabric-softening properties have also been proposed for incorporation in detergent compositions.

The present invention, however, is concerned with the improvement of fabric-softening compositions containing fabric-softening agents of the type of organic compounds mentioned above.

Generally, and by all means preferably, such fabric-softening detergent compositions are presented in the form of a particulate product.

Since said usable fabric-softening agents are generally waxy solid compounds of rather low melting points, the incorporation of said compounds in granular, particulate or powdered detergent compositions has created problems in that they may degrade under certain processing conditions, e.g. if incorporated in the slurry before spray-drying, or in that they affect the physical properties of the powder resulting in poor free-flowing properties, tendency to caking and/or bleeding or exudation on the pack, if sprayed as a melt or in solvent dissolution in the required quantities onto the spray-dried base powder granules or onto a particulate component or components of the composition, as proposed in European Patent Applications No. 0011340, No. 0023367 and No.0026528.

It has now been found that fabric-softening agents of the above type can be safely and satisfactorily incorporated as solid, free-flowing particles in granular, particulate or powdered detergent compositions without the above drawbacks, by spraying said fabric-softening agent in liquefied form by melting or in solvent dissolution onto sodium perborate monohydrate particles. Sodium perborate monohydrate has the formula $NaBO_2.H_2O_2$, as distinct from sodium perborate tetrahydrate having the formula $NaBO_2.3H_2O.H_2O_2$, which is commonly used in detergent compositions.

A major advantage of sodium perborate monohydrate as solid carrier material is that it can absorb up to about 100% of its weight of the fabric-softening agent without the chemical and/or physical characteristics of both the solid support and the liquefied fabric-softening components being changed. Also, the high absorption capacity is of great advantage to enable sufficient fabric-softening agent to be safely incorporated in the detergent composition at low levels of carrier material without the risk of causing tendency to caking or bleeding, which cannot be achieved with any other component of the detergent composition or with the spray-dried detergent granules as carrier material.

Without wishing to be bound to any theoretical considerations, it is believed that the excellent free-flowing properties of the particles of the invention are due to the typical pore structure of perborate monohydrate, which allows the liquefied fabric-softening agent sprayed onto it to diffuse quickly and completely through the pores of the perborate monohydrate and solidify therein, forming a firm matrix.

Spray-dried detergent base powder granules and any other particulate component do not have this capacity and will cause the fabric-softening agent sprayed thereon to remain on the surface as surface coating or to be inadequately absorbed, with the consequence of giving tendency to bleeding, poor free-flowing properties and/or caking.

Accordingly, in one aspect of the invention there is provided a free-flowing particulate fabric-softening adjunct comprising sodium perborate monohydrate having absorbed therein from about 5% up to about 100% of its weight of a fabric-softening agent selected from the group consisting of organic compounds which contain primary, secondary, tertiary or quaternary nitrogen, or which are phosphonium or sulphonium compounds, having at least one, preferably two, relatively long hydrocarbon group substituents having from 6–22 carbon atoms conferring hydrophobicity and lubricity, and mixtures thereof.

In another aspect of the invention there is provided an improved fabric-softening detergent composition comprising a dry mixture of a laundry detergent base powder and a particulate fabric-softening adjunct comprising sodium perborate monohydrate having absorbed therein from about 5% up to about 100% of its weight of a fabric-softening agent selected from the group consisting of organic compounds which contain primary, secondary, tertiary or quaternary nitrogen, or which are phosphonium or sulphonium compounds, and have at least one, preferably two, relatively long hydrocarbon group substituents having from 6–22 carbon atoms conferring hydrophobicity and lubricity; and mixtures thereof.

In a further aspect of the invention there is provided a method of preparing a free-flowing particulate fabric-softening adjunct which comprises the steps of liquefying an organic fabric-softening agent selected from the group consisting of organic compounds which contain primary, secondary tertiary or quaternary nitrogen, or which are phosphonium or sulphonium compounds, having at least one, preferably two, relatively long hydrocarbon substituents having 6–22 carbon atoms, conferring hydrophobicity and lubricity, and mixtures thereof, and spraying said liquefied fabric-softening agent onto a moving bed of sodium perborate monohydrate particles in an amount of from about 5 to 100% by weight of the sodium perborate monohydrate.

The fabric-softening agent prior to spraying can be liquefied by melting or by dissolution in a solvent. The solvent usable here is preferably an inert volatile organic solvent which is removed from the particles on weathering.

Preferred fabric-softening agents are water-insoluble tertiary amines having the general formula:

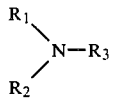

wherein $R_1$ is a $C_{10}$–$C_{26}$ alkyl or alkenyl group, $R_2$ is the same as $R_1$ or if $R_1$ is a $C_{20}$–$C_{26}$ alkyl or alkenyl group, may be a $C_1$–$C_7$ alkyl group and $R_3$ has the formula $—CH_2—Y$, wherein Y is H,

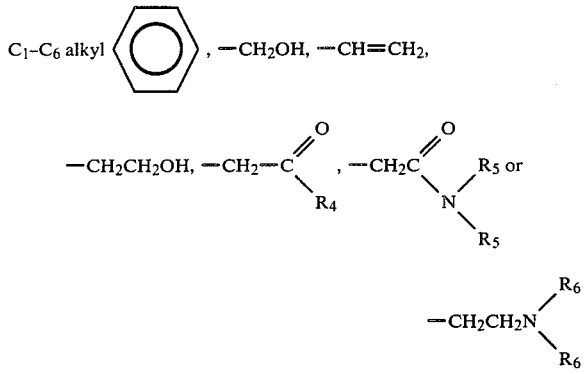

wherein $R_4$ is a $C_1$–$C_4$ alkyl group, each $R_5$ is independently H or $C_1$–$C_{20}$, and each $R_6$ is independently H or $C_1$–$C_{20}$ alkyl Preferably $R_1$ and $R_2$ each independently represent a $C_{12}$–$C_{22}$ alkyl group, preferably straight-chained and $R_3$ is methyl or ethyl. Suitable amines include:

didecyl methylamine
dilauryl methylamine
dimyristyl methylamine
dicetyl methylamine
distearyl methylamine
diarachidyl methylamine
dibehenyl methylamine
arachidyl behenyl methylamine or
di (mixed arachidyl/behenyl) methylamine
di (tallowyl) methylamine
arachidyl/behenyl dimethylamine and the corresponding ethylamines, propylamines and butylamines. Especially preferred is ditallowyl methylamine. This is commercially available as Armeen M2HT from Akzo N.V., as Genamin SH301 from Farbwerke Hoechst, and as Noram M2SH from the CECA Company.

When Y is

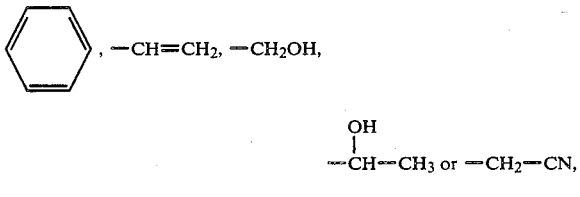

suitable amines include:

didecyl benzylamine
dilauryl benzylamine
dimyristyl benzylamine
dicetyl benzylamine
distearyl benzylamine
dioleyl benzylamine
dilinoleyl benzylamine
diarachidyl benzylamine
dibehenyl benzylamine
di (arachidyl/behenyl) benzylamine
ditallowyl benzylamine and the corresponding allylamines, hydroxy ethylamines, hydroxy propylamines and 2-cyanoethylamines. Especially preferred are ditallowyl benzylamine and ditallowyl allylamine.

Mixtures of any of these amines may be used. A preferred sodium perborate monohydrate usable as a carrier in the present invention will have an average particle diameter of about 350–450 μm.

The laundry detergent base powder

The laundry detergent base powder usable in the present invention is not critical and may be of the conventional types. The composition and manufacture of such free-flowing detergent base powders are known to the skilled artisan.

Preferred laundry detergent base powder compositions for use in the present invention will comprise from about 2–50% by weight of an organic surfactant selected from the group of anionic surfactants and nonionic surfactants and mixtures thereof; up to 80% by weight of a detergency builder which may be selected from the group of organic or inorganic builders, water-insoluble sodium aluminosilicates, and mixtures thereof; and up to 30% by weight of optional ingredients usually found in laundry detergent compositions such as other types of organic surfactants, suds-depressing agents, soil-suspending and anti-redeposition agents, heavy metal sequestrants and anti-corrosion agents, optical brighteners, colouring agents, perfumes, fillers, proteolytic enzymes and, as desired, additional bleaching agents, bleach activators and bleach stabilisers.

The compositions may contain from 0% to 50% by weight of anionic surfactants, preferably from 2% to 30% by weight.

Suitable anionic non-soap surfactants are water-soluble salts of alkyl benzene sulphonates, alkyl sulphates, alkyl polyethoxy ether sulphates, paraffin sulphonates, alpha-olefin sulphonates, alpha-sulphocarboxylates and their esters, alkyl glyceryl ether sulphonates, fatty acid monoglyceride sulphates and sulphonates, alkyl phenol polyethoxy ether sulphates, 2-acyloxy-alkane-1-sulphonates and beta-alkyloxy alkane sulphonates. Soaps are also suitable anionic surfactants.

Especially preferred alkyl benzene sulphonates have about 9 to about 15 carbon atoms in a linear or branched alkyl chain, more especially about 11 to about 13 carbon atoms. Suitable alkyl sulphates have about 10 to about 22 carbon atoms in the alkyl chain, more especially from about 12 to about 18 carbon atoms. Suitable alkyl polyethoxy ether sulphates have about 10 to about 18 carbon atoms in the alkyl chain and have an average of about 1 to about 12 $—CH_2CH_2O$ groups per molecule, especially about 10 to about 16 carbon atoms in the alkyl chain and an average of about 1 to about 6 $—CH_2CH_2O$ groups per molecule.

Suitable paraffin sulphonates are essentially linear and contain from about 8 to about 24 carbon atoms, more especially from about 14 to about 18 carbon atoms. Suitable alpha-olefin sulphonates have about 10 to about 24 carbon atoms, more especially about 14 to about 16 carbon atoms; alpha-olefin sulphonates can be made by reaction with sulphur trioxide, followed by neutralization under conditions such that any sultones present are hydrolyzed to the corresponding hydroxy alkane sulphonates. Suitable alpha-sulphocarboxylates contain from about 6 to about 20 carbon atoms; included herein are not only the salts of alpha-sulphonated fatty acids but also their esters made from alcohols containing about 1 to about 14 carbon atoms. Suitable alkyl glyceryl ether sulphates are ethers of alcohols having about 10 to about 18 carbon atoms, more especially those derived from coconut oil and tallow. Suitable alkyl phenol polyethoxy ether sulphates have about 8 to about 12 carbon atoms in the alkyl chain and an average of about 1 to about 6 $—CH_2CH_2O$ groups per molecule. Suitable 2-acyloxyalkane-1-sulphonates contain from about 2 to about 9 carbon atoms in the acyl group and about 9 to about 23 carbon atoms in the alkane moiety. Suitable beta-alkyloxy alkane sulphonates contain about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example by using the Ziegler or Oxo processes. Water-solubility can be achieved by using alkali metal, ammonium or alkanolammonium cations: sodium is preferred. Mixtures of anionic surfactants are contemplated by this invention; a satisfactory mixture contains alkyl benzene sulphonate having 11–13 carbon atoms in the alkyl group and alkyl sulphate having 12 to 18 carbon atoms in the alkyl group.

Suitable soaps contain about 8 to about 18 carbon atoms, more especially about 12 to about 18 carbon atoms. Soaps can be made by direct saponification of natural fats and oils such as coconut oil, tallow and palm oil, or by the neutralization of free fatty acids obtained from either natural or synthetic sources. The soap cation can be alkali metal, ammonium or alkanolammonium; sodium is preferred.

Nonionic surfactants may be incorporated in amounts of up to 100% by weight of the total surfactant, but normally are present in amounts of up to 75%. By total surfactant is meant the sum of the anionic surfactant and nonionic surfactant. Suitable nonionics are water-soluble ethoxylated materials of HLB 11.5–17.0 and include (but are not limited to) $C_{10}$–$C_{20}$ primary and secondary alcohol ethoxylates and $C_6$–$C_{10}$ alkylphenol ethoxylates. $C_{14}$–$C_{18}$ linear primary alcohols condensed with from seven to thirty moles of ethylene oxide per mole of alcohol are preferred, examples being $C_{14}$–$C_{15}$ $(EO)_7$, $C_{16}$–$C_{18}$ $(EO)_{25}$ and especially $C_{16}$–$C_{18}$ $(EO)_{11}$.

Detergency builder salts of the compositions, as explained, can be inorganic or organic in character. Non-limiting examples of suitable water-soluble, inorganic alkaline detergent builder salts include the alkali metal carbonates, borates, phosphates, polyphosphates, bicarbonates and silicates. Specific examples of such salts include the sodium and potassium tetraborates, bicarbonates, carbonates, triphosphates, pyrophosphates, penta-polyphosphates and hexametaphosphates.

Examples of suitable organic alkaline detergency builder salts are:

(1) water-soluble aminopolyacetates, e.g. sodium and potassium ethylenediaminetetraacetates, nitrilotriacetates, N-(2-hydroxyethyl)nitrilodiacetates and diethylene triamine pentaacetates;

(2) water-soluble salts of phytic acid, e.g. sodium and potassium phytates;

(3) water-soluble polyphosphated, including sodium, potassium and lithium salts of methylenediphosphonic acid and the like and aminopolymethylene phosphonates such as ethylenediaminetetramethylene phosphonate and diethylene triaminepentamethylene phosphate, and polyphosphonates described in British Patent Application No. 38724/77.

(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, mellitic acid and pyromellitic acid.

Mixtures of organic and/or inorganic builders can be used herein. One such mixture of builders is disclosed in Canadian Patent Specification No. 775 038, e.g. a ternary mixture of sodium tripolyphosphate, trisodium nitrilotriacetate and trisodium ethane-1-hydroxy-1,1-diphosphonate.

Another type of detergency builder material useful in the present compositions and processes comprises a water-soluble material capable of forming a water-insoluble reaction product with water hardness cations, preferably in combination with a crystallization seed which is capable of providing growth sites for said reaction product. Such "seeded builder" compositions are fully disclosed in British Patent Specification No. 1 424 406.

Preferred water-soluble builders are sodium tripolyphosphate and sodium silicate, and usually both are present. In particular, it is preferred that a substantial proportion, for instance from 3 to 15% by weight of the composition, of sodium silicate (weight ratio $SiO_2$:$Na_2O$ from 1:2 to 3.5:1) be employed.

A further class of detergency builder materials are insoluble sodium aluminosilicates, particularly those described in Belgian Patent Specification No. 814 874, issued 12th Nov. 1974. This patent specification discloses and claims detergent compositions containing sodium aluminosilicate of the formula:

$$Na_z(AlO_2)_z(SiO_2)_y xH_2O,$$

wherein z and y are integers equal to at least 6, the molar ratio of z to y is in the range from 1.0:1 to about 0.5:1 and x is an integer from about 15 to about 264. A preferred material is $Na_{12}(SiO_2AlO_2)_{12}27H_2O$. About 5% to 25% by weight of aluminosilicate may be used as a partial replacement for water-soluble builder salts, provided that sufficient water-soluble alkaline salts remain to provide the specified pH of the composition in aqueous solution.

The detergency builders are normally included in amounts of from 10% to 80% by weight of the composition, preferably from 30 to 70% and most usually from 30% to 60% by weight.

The laundry detergent base powder may be obtained by any known technique, such as dry mixing or co-granulation of the components. Conventionally, the laundry detergent base powder for admixture with the fabric-softening adjuncts of the invention is prepared by spray-drying an aqueous slurry of the non-heat-sensitive ingredients, forming spray-dried granules to which there may be added other solid ingredients as desired, such as enzymes, additional bleaching agents and the like.

Alternatively, the laundry detergent base powder may be formed solely of the spray-dried granules and the other solid ingredients may be added together with or after admixture with the fabric-softening adjunct.

The ratio by weight of laundry detergent base powder, including the other post-dosed ingredients, to fabric-softening adjunct in the fabric-softening detergent composition of the invention will be within a range so as to achieve a fabric-softening agent content of about 0.5–25%, preferably from 1–15% by weight of the total composition and therefore it will depend upon the content of fabric-softening agent in the particulate fabric-softening adjunct.

A preferred fabric-softening adjunct will comprise from about 50–85% by weight of sodium perborate monohydrate and from about 50–15% by weight of fabric-softening agent. The present invention not only resolves the problems of poor free-flowing characteristics, tendency to caking and bleeding of the fabric-softening agent from the powder of fabric-softening detergent powder compositions without affecting the fabric-softening performance, but it has also an extra advantage in that the sodium perborate monohydrate provides an improved cleaning and stain-removing performance of the fabric-softening detergent composition.

The invention is illustrated in the following nonlimiting examples.

EXAMPLE I

The following granular laundry detergent base composition was prepared by a conventional technique of spray-drying an aqueous slurry:

| Composition | parts by weight |
|---|---|
| Sodium linear $C_{12}$ alkyl benzene sulphonate | 6.0 |
| $C_{13}$–$C_{15}$ fatty alcohol/11 Ethylene oxide | 3.0 |
| Sodium stearate | 2.0 |
| Sodium triphosphate | 33.0 |
| Sodium silicate ($Na_2O:SiO_2$ = 2:1) | 6.0 |
| Optical brightener | 0.2 |
| Sodium sulphate | 15.0 |
| Moisture + miscellaneous | 9.0 |

(a) Spray-dried base powder granules as carrier material

Onto these spray-dried detergent base powder granules a melt of di-hardened tallow methylamine fabric-softening agent was sprayed, using a conventional granulating equipment, at a level of 5.6% by weight of the total composition.

The powder obtained was of unsatisfactory quality in that it shows poor flow properties (creepy powder), tendency to caking on storage and, when packed in carton containers, bleeding or exudation on the cartons was observed.

(b) Sodium sulphate as carrier material

Onto a moving bed of sodium sulphate 15 to 20% by weight of a melt of di-hardened tallow methylamine fabric-softening agent was sprayed for 13 minutes in a conventional granulating equipment. The granules obtained after standing show strong tendency to agglomerate and to cake.

(c) Sodium perborate monohydrate as carrier material

The sodium perborate monohydrate used in the test had a bulk density of about 0.5 g/cm$^3$ and an average particle diameter of about 400 $\mu$m.

Onto a moving bed of the sodium perborate monohydrate a melt of di-hardened tallow methylamine fabric-softening agent having a temperature varying from 60–100° C. was sprayed up to a level of amine to perborate weight ratio of 30/70.

The particles obtained showed good free-flowing properties without the slightest tendency to caking or agglomeration.

The following table shows characteristics of sodium perborate monohydrate before and after treatment with di-hardened tallowyl methylamine:

TABLE 1

| | Dynamic flow rate (DFR) | % compression | Flow number |
|---|---|---|---|
| Before | 123 cm$^3$/sec. | 3 | 120 |
| After | 127 cm$^3$/sec. | 2 | 125 |

When this treated sodium perborate monohydrate was mixed as fabric-softening adjunct with the granular spray-dried detergent base composition above, a free-flowing flowing fabric-softening detergent composition was obtained with no tendency to caking.

The physical characteristics of sodium perborate monohydrate and sodium sulphate before and after amine spraying at 30/70 ratio are shown in the following table 2.

TABLE 2

| | | Before | After |
|---|---|---|---|
| sodium perborate monohydrate | Av. part. diameter | 360 microns | 335 microns |
| | N (% compression) | 3 | 2 |
| | Bulk density | 0.51 | 0.87 |
| sodium sulphate | Av. part. diameter | 200 microns | 817 microns |
| | N (% compression) | 1.2 | 2 |
| | Bulk density | 1.4 | 0.9 |

N.B. Density of ditallow methylamine = 0.8.

The above table shows a clear distinction between the manner of uptaking the melted amine by perborate monohydrate and sodium sulphate. In the case of perborate monohydrate there is substantially no increase in particle diameter and there is an increase of bulk density, which are indicative of almost complete absorption of the amine by the sodium perborate monohydrate particles. In contrast thereto, there is a substantial increase in particle diameter and a decrease of bulk density of the sodium sulphate particles, which are indicative of surface coating of the sodium sulphate by the amine with substantially no absorption.

EXAMPLE II

Cleaning tests were carried out with the following two detergent powder formulations in a Thomson® T4515 washing machine under the following washing conditions:

heat up cycle to 80° C.
powder dosage: 225 ml or 112.5 g.
wash load: 4 kg (cotton).
water hardness: 30° F. Hardness.
repeated washings: 5 ×.

| Compositions | A % by weight | B % by weight |
|---|---|---|
| Conventional ternary active laundry base powder | 69.72 | 68.76 |
| Sodium perborate tetrahydrate | 21.0 | — |
| Fabric-softening adjunct* | — | 17.65 |
| Sodium sulphate | 9.0 | 13.31 |
| Proteolytic enzyme granules | 0.28 | 0.28 |
| Bulk density | 0.5 | 0.5 |

*Sodium perborate monohydrate/ditallow methylamine (77/23) particles.
N.B. Composition A and Composition B contain the same percentage of pure sodium perborate, i.e. 13.65%.

The bleaching and cleaning results on different stains, measured as reflectance values (ΔR 460*), are shown below:

| | Composition A Δ R 460* | Composition B Δ R 460* |
|---|---|---|
| tea stains | 4.5 | 13.6 |
| coffee stains | 9.8 | 13.9 |
| wine stains | 23.9 | 30.3 |

The extra advantage of the composition (B) of the invention over a conventional product (A) containing sodium perborate tetrahydrate in the overall cleaning/-stain-removing performance is evident.

We claim:

1. Free-flowing particulate fabric-softening adjunct for use in laundry detergent composition comprising sodium perborate monohydrate having absorbed therein from about 5% up to about 100% of its weight of a fabric-softening agent selected from the group consisting of organic compounds which contain primary, secondary, tertiary or quaternary nitrogen, or which are phosphonium or sulphonium compounds, having at least one relatively long hydrocarbon group substituent having 6–22 carbon atoms conferring hydrophobicity and lubricity, and mixtures thereof.

2. Free-flowing particulate fabric-softening adjunct according to claim 1, wherein said fabric-softening agent is a water-insoluble tertiary amine having the general formula:

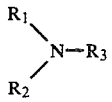

wherein $R_1$ is a $C_{10}$–$C_{26}$ alkyl or alkenyl group, $R_2$ is the same as $R_1$ or if $R_1$ is a $C_{20}$–$C_{26}$ alkyl or alkenyl group, may be a $C_1$–$C_7$ alkyl group and $R_3$ has the formula —$CH_2$—Y, wherein Y is H,

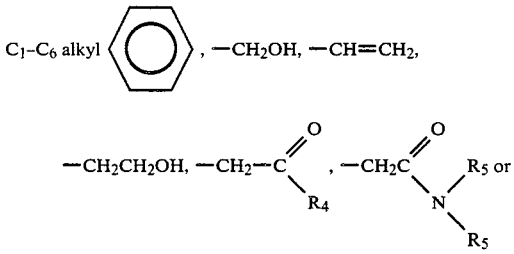

-continued

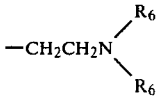

wherein $R_4$ is a $C_1$–$C_4$ alkyl group, each $R_5$ is independently H or $C_1$–$C_{20}$, and each $R_6$ is independently H or $C_1$–$C_{20}$ alkyl.

3. Free-flowing particulate fabric-softening adjunct according to claim 1, which comprises from 50–85% by weight of sodium perborate monohydrate and from 50–15% by weight of fabric-softening agent.

4. Free-flowing particulate fabric-softening adjunct according to claim 1, wherein said sodium perborate monohydrate has an average particle diameter of about 350–450 μm.

5. Process for preparing a free-flowing particulate late fabric-softening adjunct which comprises the steps of liquefying an organic fabric-softening agent selected from the group consisting of organic compounds which contain primary, secondary, tertiary or quaternary nitrogen, or which are phosphonium or sulphonium compounds, having at least one relatively long hydrocarbon substituent having 6–22 carbon atoms, conferring hydrophobicity and lubricity, and mixtures thereof, and spraying said liquefied fabric-softening agent onto a moving bed of sodium perborate monohydrate in an amount of from 5 to 100% by weight of the sodium perborate monohydrate.

6. Process according to claim 5, wherein said fabric-softening agent prior to spraying is liquefied by melting.

7. Process according to claim 5, wherein said fabric-softening agent prior to spraying is liquefied by solvent dissolution.

8. Process according to claim 5, wherein said fabric-softening agent is a tertiary amine having the general formula:

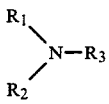

wherein $R_1$ is a $C_{10}$–$C_{26}$ alkyl or alkenyl group, $R_2$ is the same as $R_1$ or if $R_1$ is a $C_{20}$–$C_{26}$ alkyl or alkenyl group, may be a $C_1$–$C_7$ alkyl group and $R_3$ has the formula —$CH_2$—Y, wherein Y is H,

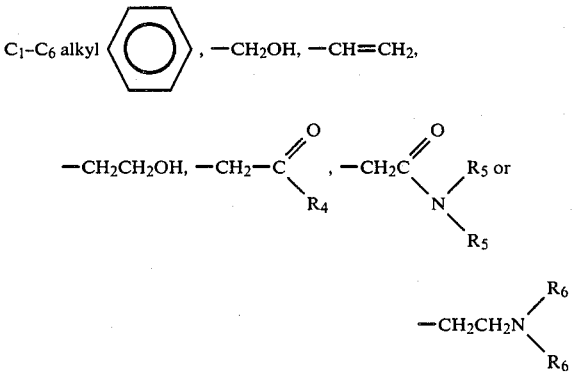

wherein $R_4$ is a $C_1$–$C_4$ alkyl group, each $R_5$ is independently H or $C_1$–$C_{20}$, and each $R_6$ is independently H or $C_1$–$C_{20}$ alkyl.

9. Process according to claim 5, wherein said perborate monohydrate has an average particle diameter of about 350–450 μm.

10. Fabric-softening detergent composition comprising a dry mixture of a laundry detergent base powder and a free-flowing particulate fabric-softening adjunct comprising sodium perborate monohydrate having absorbed therein from about 5 to about 100% by weight of a fabric-softening agent selected from the group consisting of organic compounds which contain primary, secondary, tertiary or quaternary nitrogen, or which are phosphonium or sulphonium compounds, having at least one relatively long hydrocarbon substituent having 6–22 carbon atoms conferring hydrophobicity and lubricity, and mixtures thereof.

11. Fabric-softening detergent composition according to claim 10, wherein said laundry detergent base powder comprises from 2–50% by weight of an organic surfactant selected from the group consisting of anionic surfactants and nonionic surfactants and mixtures thereof and from 10–80% by weight of a detergency builder, and said fabric-softening adjunct being rated in a weight ratio such that the total composition has a fabric-softening agent content of 0.5–25% by weight.

12. Fabric-softening detergent composition according to claim 10, wherein said fabric-softening agent is a tertiary amine having the general formula:

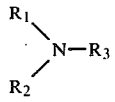

wherein $R_1$ is a $C_{10}$–$C_{26}$ alkyl or alkenyl group, $R_2$ is the same as $R_1$ or if $R_1$ is a $C_{20}$–$C_{26}$ alkyl or alkenyl group, may be a $C_1$–$C_7$ alkyl group and $R_3$ has the formula $—CH_2—Y$, wherein Y is H,

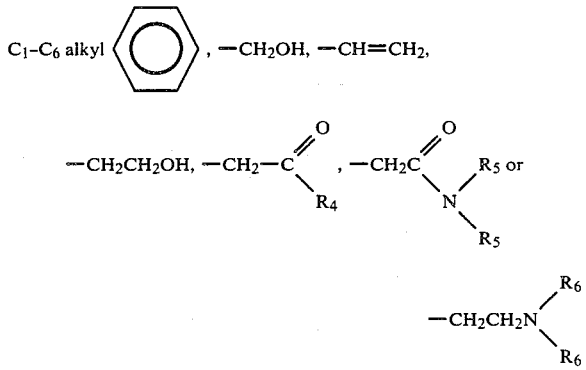

wherein $R_4$ is a $C_1$–$C_4$ alkyl group, each $R_5$ is independently H or $C_1$–$C_{20}$, and each $R_6$ is independently H or $C_1$–$C_{20}$ alkyl.

13. Fabric-softening detergent composition according to claim 10, wherein said sodium perborate monohydrate has an average particle size of 350–450 μm.

14. Fabric-softening detergent composition according to claim 11, which comprises from 2–30% by weight of an anionic surfactant, from 30–70% by weight of a detergency builder and from 1–15% by weight of said fabric-softening agent.

* * * * *